US010267494B1

(12) United States Patent
Palase

(10) Patent No.: US 10,267,494 B1
(45) Date of Patent: Apr. 23, 2019

(54) GUARD FOR A LUMINAIRE

(71) Applicant: Appleton Grp LLC, Rosemont, IL (US)

(72) Inventor: Jinchandra S. Palase, Pune (IN)

(73) Assignee: Appleton Grp LLC, Rosemount, IL (US)

( * ) Notice: Subject to any disclaimer, the term of this patent is extended or adjusted under 35 U.S.C. 154(b) by 0 days.

(21) Appl. No.: 15/903,302

(22) Filed: Feb. 23, 2018

(30) Foreign Application Priority Data

Dec. 19, 2017 (IN) ..... 201721045687

(51) Int. Cl.

| | |
|---|---|
| ***F21V 15/02*** | (2006.01) |
| ***F21V 17/16*** | (2006.01) |
| ***F21W 131/40*** | (2006.01) |
| ***F21W 131/105*** | (2006.01) |

(52) U.S. Cl.
CPC ..... *F21V 15/02* (2013.01); *F21V 17/164* (2013.01); *F21W 2131/105* (2013.01); *F21W 2131/40* (2013.01)

(58) Field of Classification Search
CPC ..... F21L 14/00; F21L 14/02; F21L 14/023; F21S 6/002; F21S 6/007; F21V 11/04; F21V 15/00; F21V 15/005; F21V 15/02; F21V 17/108; F21V 17/12; F21V 17/164; F21V 17/166; F21V 29/70; F21V 29/74; F21V 17/00; F21V 17/06; F21V 17/10; F21W 2131/1005; F21W 2131/105; F21W 2131/40; F21Y 2103/10
See application file for complete search history.

(56) References Cited

U.S. PATENT DOCUMENTS

| | | | | | |
|---|---|---|---|---|---|
| 1,291,825 | A * | 1/1919 | Gargan | F21V 19/02 | 362/285 |
| 1,625,693 | A * | 4/1927 | Vest | G09F 13/16 | 340/815.73 |
| 2,469,412 | A * | 5/1949 | Roebken | A61N 5/06 | 250/504 R |
| 2,812,423 | A * | 11/1957 | Penna | B60Q 7/00 | 116/202 |
| 3,461,283 | A * | 8/1969 | Hahn | F21S 8/04 | 362/235 |
| 4,081,668 | A * | 3/1978 | Mori | F21V 17/102 | 362/296.01 |
| 4,310,874 | A * | 1/1982 | Spiteri | F21L 14/02 | 362/212 |

(Continued)

*Primary Examiner* — Peggy A Neils
(74) *Attorney, Agent, or Firm* — McDonnell Boehnen Hulbert & Berghoff, LLP

(57) ABSTRACT

A guard for a luminaire including a guard portion (102), at least one connecting legs (104) extending from a periphery of the guard portion (102). The guard (100) is mounted on the periphery of luminaire (110) via complementary connection formations configured on the periphery of the luminaire (110), a hook like profile (106) configured at an operative free end of the connecting legs (104) to provide a secure fitment of the guard (100) in the connection formations. The guard (100) includes a first pair (104A), a second pair (104B) and a third pair (104C) to provide three point locking of the guard (100) on the luminaire periphery (110). A stiffener element (108) is welded in an L-shaped luminaire (107) defined by a first section (107A) and a second section (107B) to provide stiffness to the connecting legs (104).

6 Claims, 3 Drawing Sheets

(56) References Cited

U.S. PATENT DOCUMENTS 4,344,114 A * 8/1982 Denhart ..... F21S 8/04
362/145
4,998,192 A * 3/1991 Arndt ..... F21S 6/002
362/376
4,999,752 A * 3/1991 Rogers ..... F21L 14/023
315/165
5,243,507 A * 9/1993 Atkins ..... F21L 14/00
362/269
D375,381 S * 11/1996 Carr ..... D26/119
5,660,464 A * 8/1997 Lin ..... F21V 15/02
362/374
5,718,506 A * 2/1998 Yeh ..... F21S 6/007
362/344
5,767,782 A * 6/1998 Mongeau ..... F21V 15/02
248/551
5,902,037 A * 5/1999 Turner ..... F21S 6/007
362/376
5,961,207 A * 10/1999 Petkovic ..... F21L 14/02
362/376
6,027,232 A * 2/2000 Lin ..... F21S 6/005
362/344
6,309,091 B1 * 10/2001 Weissman ..... F21S 6/005
362/279
D467,027 S * 12/2002 Huang ..... D26/119
6,668,818 B2 * 12/2003 Bossier ..... F24C 1/10
126/91 R
D604,891 S * 11/2009 Nathan ..... D26/119
7,971,844 B2 * 7/2011 Newport ..... G01D 11/245
248/320
8,845,405 B2 * 9/2014 Greenberg ..... F24F 13/082
454/367

* cited by examiner

GUARD FOR A LUMINAIRE

RELATED APPLICATION

This application claims priority to Indian Application No. 201721045687 entitled "A Guard for a Luminaire" filed on Dec. 19, 2017, the contents of which are incorporated by reference herein in their entirety.

FIELD

The present disclosure relates to the field of lighting fixtures.

BACKGROUND

Luminaires, such as LED lighting fixtures, find wide applications in illuminating large areas these days, e.g., industrial set ups, sport arenas, and the like. These luminaires typically include a diffuser panel, made of a transparent material, which performs the function of covering the light source as well as providing improved illumination. Typically, the transparent material used for making the diffuser panel is glass. The glass diffuser panels are generally protected by a protecting device such as a guard. Typically, the guard safeguards the diffuser panel of the luminaire from accidental damages. Furthermore, the guard also helps in preventing any accidental burns to the human operator performing emergency maintenance procedures on the luminaire. Conventionally, the guard is secured onto the luminaire by means of fasteners, e.g., a nut and bolt assembly. The use of fasteners also necessitates the use of tools required for assembling the fasteners. For performing these fastening operations, the human operator has to be elevated to the height of the lighting fixture and perform the fastening operations at that height. This method of fixing the guard on the luminaire is laborious, time consuming, and unsafe.

There is, therefore, felt a need for a guard with an improved design that obviates the aforementioned drawbacks associated with the conventional guards for luminaires.

OBJECTS

Some of the objects of the present disclosure, which at least one embodiment herein satisfies are as follows:

An object of the present disclosure is to provide a guard for a luminaire that is easy to assemble.

Another object of the present disclosure is to provide a guard for a luminaire that eliminates the need of fasteners and additional tools for fixing the guard on the luminaire.

Other objects and advantages of the present disclosure will be more apparent from the following description when read in conjunction with the accompanying figure, which are not intended to limit the scope of the present disclosure.

SUMMARY

The present disclosure envisages a guard for a luminaire. The guard comprises a guard portion configured to guard a diffuser panel of the luminaire, and at least one connecting leg extending from a periphery of the guard portion for facilitating mounting of the guard on the luminaire.

In an embodiment, the connecting legs are configured to fit onto a heat sink of the luminaire.

In another embodiment, the connecting legs have a hook-like profile configured at a free operative end thereof, wherein the hook-like profile facilitates a secure fitment of the connecting legs on the heat sink.

In another embodiment, the guard includes a first pair of connecting legs extending from an operative top end of the guard portion, a second pair of connecting legs extending from a first operative side, and a third pair of connecting legs extending from a second operative side, thereby providing three point locking to the guard on the luminaire.

In another embodiment, the connecting legs include a first section and a second section which define an L-shaped profile.

In another embodiment, a stiffener element is provided on the connecting legs for providing stiffness to the connecting legs, wherein the stiffener element is welded onto the first section and the second section.

BRIEF DESCRIPTION OF THE ACCOMPANYING DRAWING

A guard for a luminaire, of the present disclosure, will now be described with the help of the accompanying drawing, in which.

LIST OF REFERENCE NUMERALS

100 A Guard
102 Guard Portion
104 Connecting legs
104A First Pair of Connecting Legs
104B Second Pair of Connecting Legs
104C Third Pair of connecting Legs
106 Hook like Profile
107 L-Shaped Profile
107A First Section
107B Second Section
108 Stiffener Element
110 Periphery of Luminaire
112 Luminaire
112A Heat sink
112B Plurality of fins
112C Peripheral plate
114 Diffuser panel of the luminaire

DETAILED DESCRIPTION

Luminaires or lighting fixtures have become an inseparable part of our lives. The lighting fixtures like LED lighting fixtures find numerous applications ranging from domestic lighting to industrial lighting, and also in the lighting of sports arenas such as a cricket field or a football stadium. These luminaires typically include a diffuser panel, made of a transparent material such as glass or certain kinds of plastics, which performs the function of covering the light source as well as providing improved illumination. The diffuser panel is typically protected by a guard. The guard safeguards the diffuser panel of the luminaire from accidental damages. Furthermore, the guard also helps in preventing any accidental bums to the human operator performing emergency maintenance procedures on the luminaire by preventing direct contact with the diffuser panel.

The conventional guard is fitted to the luminaire by means of fasteners. More specifically, apertures are required to be machined onto the luminaire to receive the fasteners. This increases the machining time and costs associated with the manufacturing of the luminaire. Also, the use of fasteners also necessitates the use of tools required for assembling the fasteners. For performing these fastening operations, the human operator has to be elevated to the height of the lighting fixture and perform the fastening operations at that height. This method of fixing the guard on the luminaire is laborious, time consuming, and unsafe.

In order to overcome the aforementioned drawbacks, the present disclosure envisages a tool-less design for a guard of a luminaire. More specifically, the guard of the present disclosure does not involve the use of fasteners or any kind of fastening tools for assembling the guard on the luminaire.

Figure 1A:
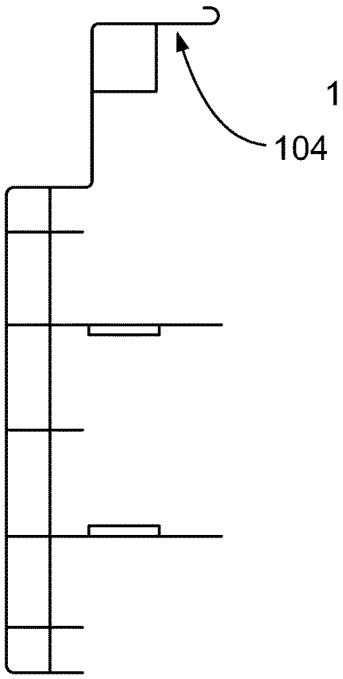
FIG. 1A illustrates a side view of the guard for the luminaire, in accordance with an embodiment of the present disclosure.
Figure 1B:
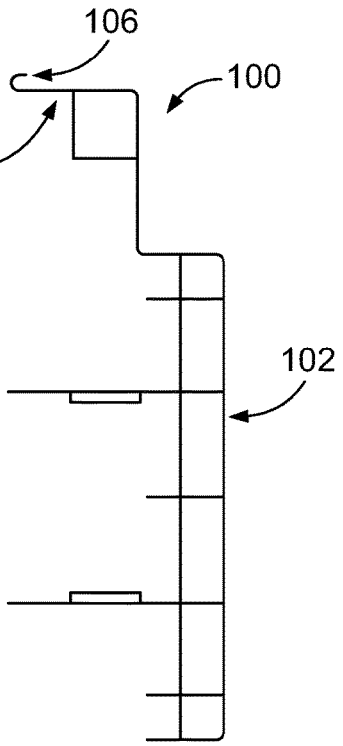
FIG. 1B illustrates another side view of the guard for the luminaire, in accordance with an embodiment of the present disclosure.
Figure 1C:
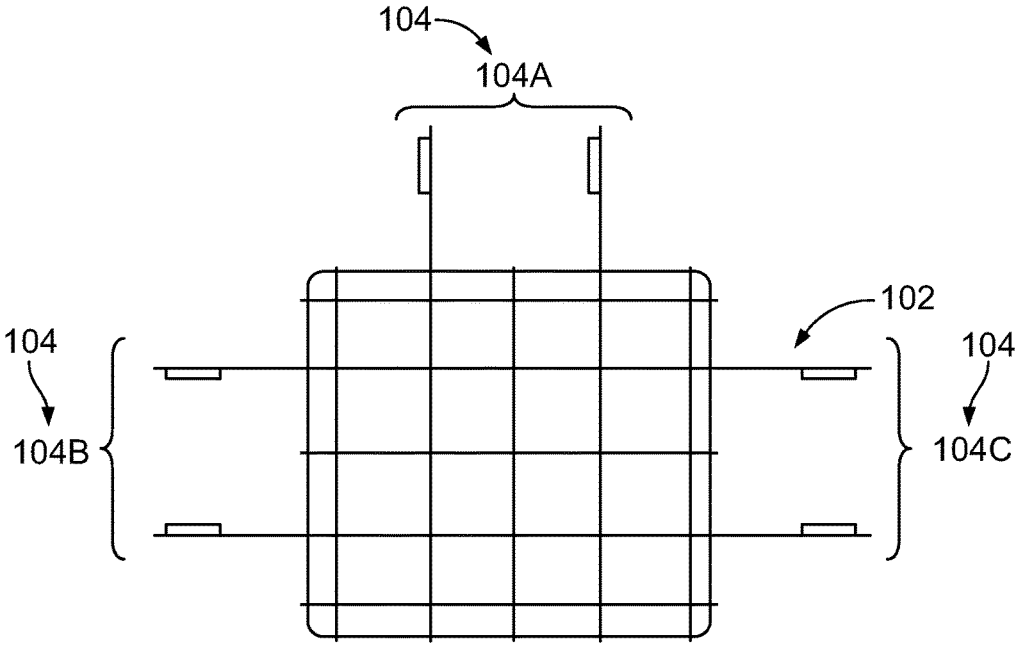
FIG. 1C illustrates a top view of the guard for the luminaire, in accordance with an embodiment of the present disclosure.
Figure 2A:
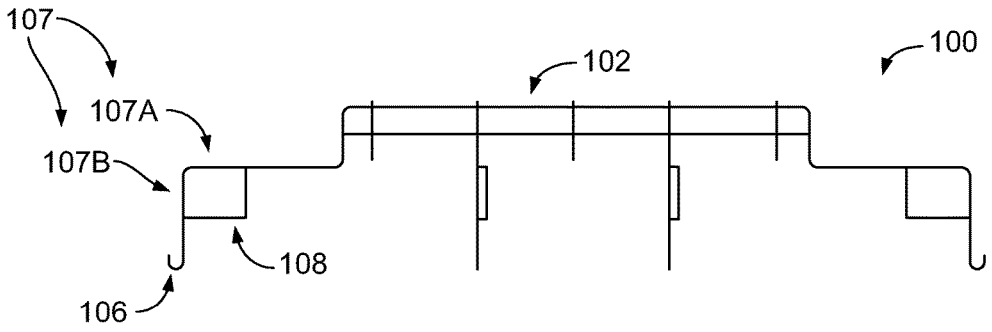
FIG. 2A illustrates a front view of the guard for the luminaire of FIG. 1C.
Figure 2B:
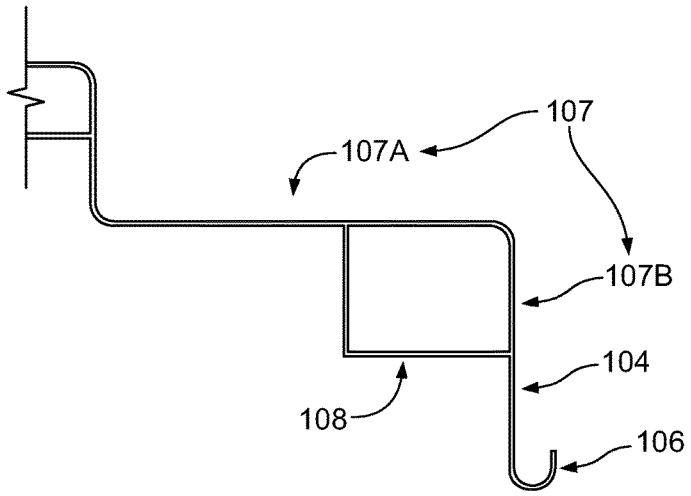
FIG. 2B illustrates a side view of an L-shaped profile of a connecting leg and the stiffener element of the guard of FIG. 2A.
Figure 3A:
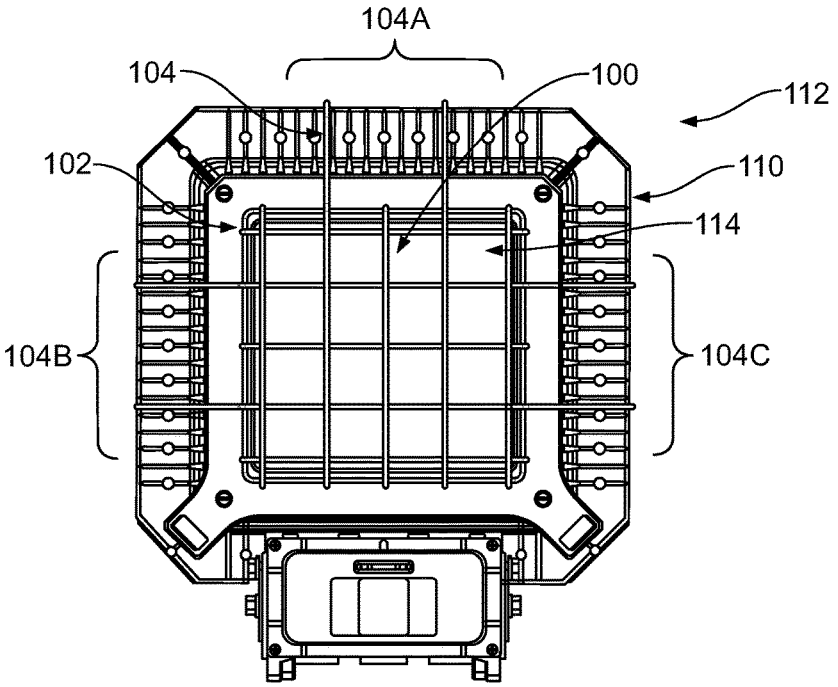
FIG. 3A illustrates a top view of the guard fixed on a periphery of luminaire, in accordance with an embodiment of the present disclosure.
Figure 3B:
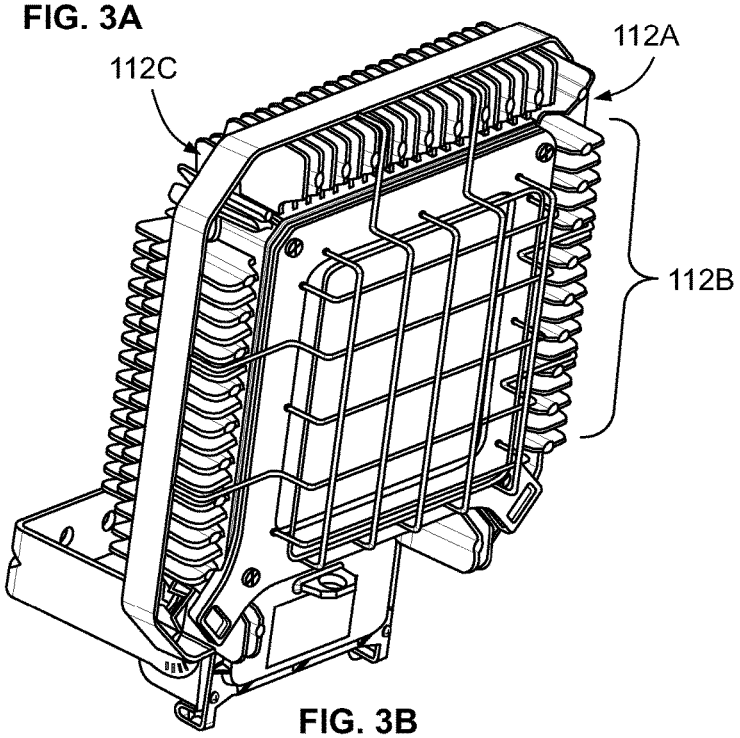
FIG. 3B illustrates an isometric view of FIG. 3A.

A guard 100 for use with a luminaire 112 is hereinafter described with reference to FIG. 1A through FIG. 3B. The guard 100, as disclosed in the present disclosure, is a tool-less guard. More specifically, the guard 100, as disclosed in the present disclosure can be press-fitted onto a heat sink of the luminaire 112, and does not require the use of any kind of fasteners or fastening tools for assembling the guard 100 onto the luminaire 112.

The guard 100 for a luminaire 112 comprises a guard portion 102 configured to guard a diffuser panel 114 of the luminaire 112. The guard 100 further comprises at least one connecting leg 104 extending from a periphery of the guard portion 102 for facilitating mounting of the guard 100 on the luminaire 112. More specifically, the guard 100 includes a first pair of connecting legs 104A extending from an operative top end of the guard portion 102, a second pair of connecting legs 104B extending from a first operative side, and a third pair of connecting legs 104C extending from a second operative side of the guard portion 102. The first, second, and third pair of connecting legs 104A, 104B, 104C provide a three point locking to the guard 100 on the luminaire 112.

In an embodiment, the connecting leg 104 includes a first section 107A and a second section 107B which define an L-shaped profile 107.

In an embodiment, the connecting legs 104 are configured to fit onto heat sink 112A of the luminaire 112. More specifically, the heat sink 112A is defined of a plurality of fins 112B and a peripheral plate 112C. The connecting legs 104 of the guard 100 are press-fitted into the space formed between the two successive fins so as to cover the diffuser panel 114 of the luminaire 112. The connecting legs 104 are resilient, and can be elastically deformed for facilitating the fitment into the space between the two successive fins. In another embodiment, the connecting legs 104 have a hook-like profile 106 configured at a free operative end thereof, wherein the hook-like profile 106 facilitates a secure fitment of the connecting legs 104 on the heat sink 112A. The connecting legs 104 hold on to the periphery of the luminaire 110 via a spring back action, thereby locking the connecting legs 104 on the heat sink 112A.

In an embodiment, the hook like profile 106 interlocks between the fins of the luminaire to securely fix the guard 100. The fixing arrangement of the guard 100 just requires a normal push force to fix the guard 100 onto the heat sink of the luminaire 110. The guard 100 of the present disclosure has optimal distance between two wire openings, which provides minimum light loss.

TECHNICAL ADVANCEMENTS

The present disclosure described herein above has several technical advantages including, but not limited to, a guard for a luminaire, which:

requires no tool for fixing the guard on the luminaire;
allows smooth and easy fitment; and
provides minimum obstruction to the light;

The disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully revealed the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

What is claimed is:

1. A guard for a luminaire, said guard (100) comprising:

a guard portion (102) configured to guard a diffuser panel of said luminaire; and at least one connecting leg (104) extending from a periphery of said guard portion (102) for facilitating mounting of said guard (100) on said luminaire;

wherein said connecting legs (104) are configured to fit onto said luminaire; and wherein said connecting legs (104) have a hook-like profile (106) configured at a free operative end thereof, said hook-like profile (106) facilitating secure fitment of said connecting legs (104) on said luminaire without the use of any fasteners.

2. A guard for a luminaire, said guard (100) comprising:

a guard portion (102) configured to guard a diffuser panel of said luminaire; and at least one connecting leg (104) extending from a periphery of said guard portion (102) for facilitating mounting of said guard (100) on said luminaire;

wherein said connecting legs (104) are configured to fit onto a heat sink of said luminaire; and wherein said connecting legs (104) have a hook-like profile (106) configured at a free operative end thereof, said hook-like profile (106) facilitating secure fitment of said connecting legs (104) on said heat sink; and further including:

a first pair of connecting legs (104A) extending from an operative top end of said guard portion (102);

a second pair of connecting legs (104B) extending from a first operative side; and a third pair of connecting legs (104C) extending from a second operative side;

thereby providing three point locking to said guard (100) on said luminaire.

3. The guard (100) as claimed in claim 2, wherein said connecting legs (104) include a first section (107A) and a second section (107B) which define an L-shaped profile (107).

4. The guard (100) as claimed in claim 3, which includes a stiffener element (108) provided on said connecting legs (104) for providing stiffness to said connecting legs (104).

5. The guard (100) as claimed in claim 4, wherein said stiffener element (108) is welded onto said first section (107A) and said second section (107B).

6. A guard for a luminaire, said guard (100) comprising:

a guard portion (102) configured to guard a diffuser panel of said luminaire; and at least one connecting leg (104) extending from a periphery of said guard portion (102) for facilitating mounting of said guard (100) on said luminaire;

wherein said connecting legs (104) are configured to fit onto a heat sink of said luminaire; and wherein said connecting legs (104) have a hook-like profile (106), said hook-like profile (106) being adapted to be press-fitted between two successive fins of a plurality of fins (112B) of said heat sink.

* * * * *